US005351068A

United States Patent [19]

Moon et al.

[11] Patent Number: 5,351,068

[45] Date of Patent: Sep. 27, 1994

[54] INK-JET PRINTER CARRIAGE AND PAPER MOTION OVERLAP METHOD AND APPARATUS

[75] Inventors: Eva-Maria Moon, Washougal, Wash.; Steven B. Elgee, Portland, Oreg.

[73] Assignee: Hewlett-Packard Company, Palo Alto, Calif.

[21] Appl. No.: 954,834

[22] Filed: Sep. 30, 1992

[51] Int. Cl.[5] ..... B41J 13/00; B41J 25/304

[52] U.S. Cl. ..... 347/101; 346/134; 400/314.1

[58] Field of Search ..... 346/140 R, 76 PH, 134; 400/1.1, 120, 126, 314.1, 322, 568, 315, 317, 320, 582, 279

[56] References Cited

U.S. PATENT DOCUMENTS 4,259,026 3/1981 Hanaoka et al. ..... 400/314.1
5,238,315 8/1993 Kitabata ..... 400/314.1

FOREIGN PATENT DOCUMENTS 2406613 8/1974 Fed. Rep. of Germany ..... 400/120
0220861 10/1986 Japan ..... 346/140 R

*Primary Examiner*—Benjamin R. Fuller
*Assistant Examiner*—N. Le

[57] ABSTRACT

Carriage and paper motion overlap method and apparatus are described. The preferred method utilizes carriage ramp-down and unidirectional, constant-speed periods of time to advance paper via the printer's paper advancement mechanism while avoiding current-intensive ramp-up periods of time during which demands on the printer's power supply are high. The printer's controller is programmed to implement preferably concurrently operable processes one of which controls paper movement and the other of which controls carriage movement. The processes signal one another based upon their monitoring of defined conditions of the printer and the print buffer, and by setting and clearing a flag.

5 Claims, 4 Drawing Sheets

INK-JET PRINTER CARRIAGE AND PAPER MOTION OVERLAP METHOD AND APPARATUS

TECHNICAL FIELD

The present invention relates generally to improving the throughput of an ink-jet printer. More particularly, the invention concerns method and apparatus that provide overlapping, or concurrent, motion between a printhead's carriage and paper motion or advancement, which minimizes wasted time and increases printer throughput without significantly increasing current demands on the printer's power supply.

BACKGROUND ART

Previously in printing methods for ink-jet printers, the printer's carriage was moved to the start of print area of a paper sheet, one or more lines was printed in a single pass of the carriage, the carriage was stopped at the end of such lines, the paper sheet was advanced, and the steps were repeated for the next lines. Much time is wasted during such conventional printing process, because of the sequential nature of the various process steps. Prior art printing methods may be summarized as having included numerous steps that were performed consecutively. Of course, the printer's paper sheet cannot be advanced during the printing of a given one or more lines printed during the passage of the printer's carriage without screwing up the printed output. On the other hand, it is desired to speed up the printing process, i.e. it is desired to increase the printer's throughput, by eliminating unnecessary delays or other wasted time. At the same time, any concurrent or overlapped movement of the printer's carriage or paper advance mechanism or firing of the ink-jet printer's ink jets preferably would not increase current demand on the printer's power supply.

DISCLOSURE OF THE INVENTION

The invented method of the invention overlaps carriage and paper advancement in time, thereby increasing throughput while not increasing peak or average power supply demand. It does so by utilizing carriage ramp-down and uni-directional, constant-speed, i.e. constant velocity, periods of time to advance paper via the printer's paper advancement mechanism. Conversely, it does so while avoiding relatively current-intensive ramp-up periods of time during which power current demand on the printer's power supply already is high.

The preferred method includes programming the printer's controller to look ahead while printing to determine whether there are impending paper advance and non-printing carriage travel. If there is the former without the latter, then when present printing is completed, paper motion is started immediately. If there is the former with the latter, then overlapped or concurrent carriage motion and paper advancement is deferred until a later time when non-printing carriage travel has reached full speed. While not printing, the controller looks ahead for an impending paper advancement. When carriage motion logic within the controller determines that fully ramped-up carriage travel speed has been achieved, then paper motion is started immediately. The beneficial result is increased printer throughput (what previously were consecutive printer carriage and paper advancement times are rendered concurrent), while during relatively current-intensive carriage ramp-up times, such concurrent paper advancement and carriage movement are avoided. Thus, printer throughput is increased without exceeding the power supply's rating.

These and additional objects and advantages of the present invention will be more readily understood after a consideration of the drawing and the detailed description of the preferred embodiment.

DETAILED DESCRIPTION OF THE PREFERRED EMBODIMENT AND BEST MODE OF CARRYING OUT THE INVENTION

Figure 1A:
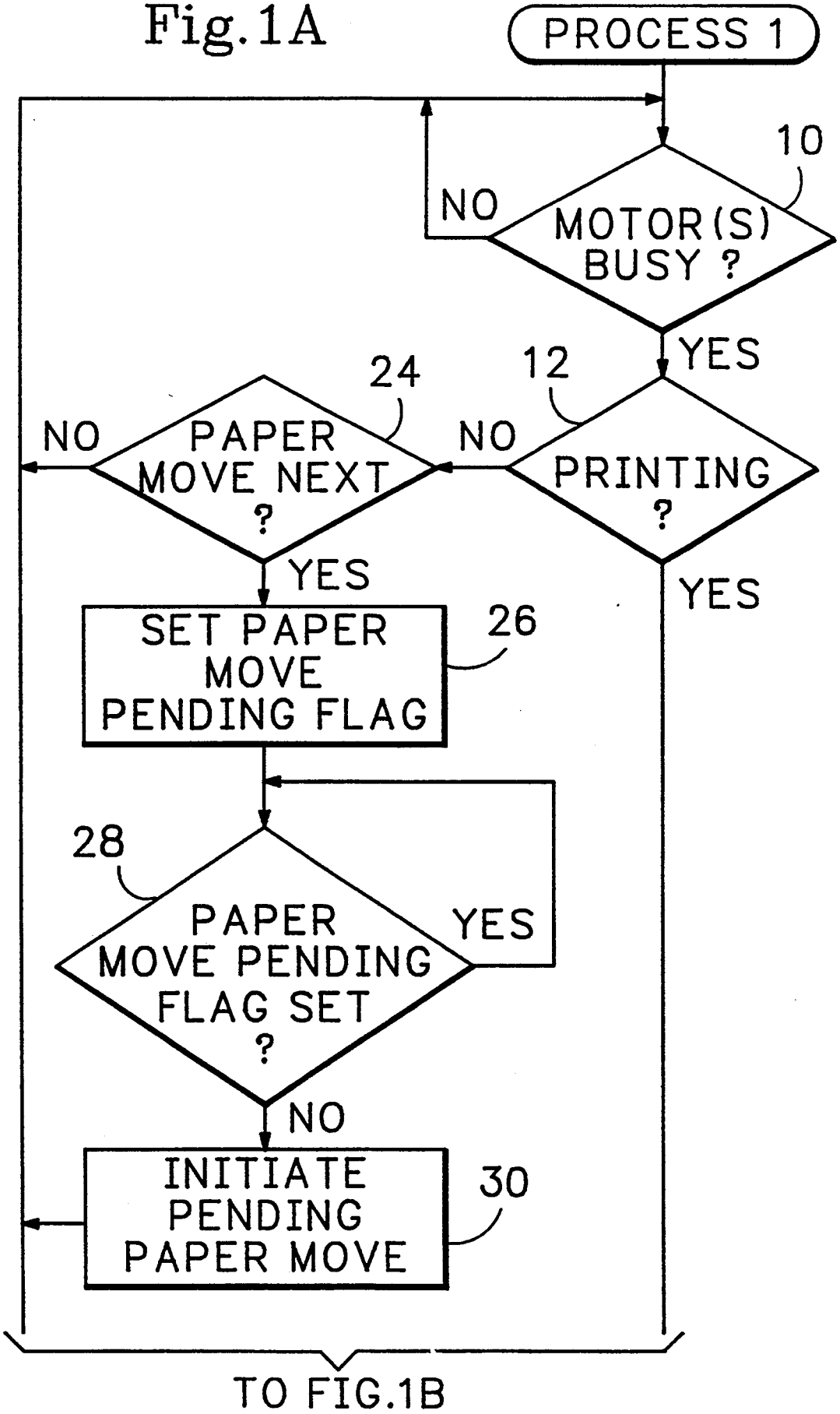
FIGS. 1A and 1B schematically illustrate one process of the invented method in the form of a flowchart.
Figure 1B:
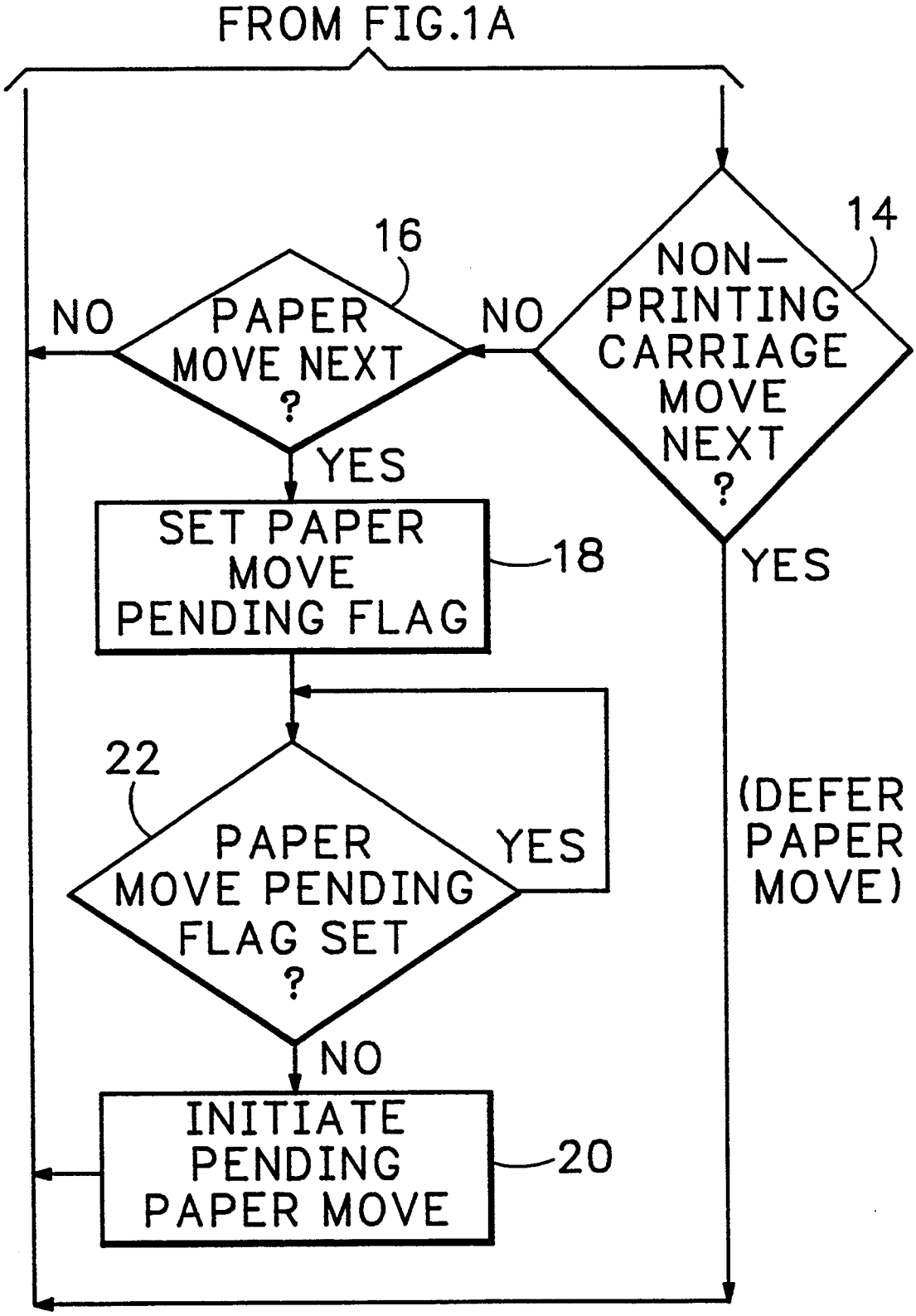

FIGS. 1A and 1B collectively show one process ("PROCESS 1") of the invented method in the form of a flowchart, which is believed to be selfexplanatory to those of skill in the art. The invented method for increasing printer throughput preferably includes the steps of 1) determining, while the printer's motor(s) are busy and while the printer is presently printing at 10, 12, 14 whether there is pending a non-printing carriage movement at 14 and if so then 2) deferring paper movement until a later time when non-printing carriage travel has reached full speed, as indicated by a return from decision block 14 to the start of PROCESS 1.

If it is determined instead at 14 that there is not pending a non-printing carriage movement, then the invented method further includes the step of 3) determining at 16 whether there is a pending a paper movement and if so then setting a paper move-pending flag at 18 and initiating paper movement at 20 immediately after printing stops as determined at 22. If it is determined at 16 that there is no pending paper movement, then control is returned to the start of PROCESS 1. By pending or impending herein is meant any predefinedly future, e.g. the next, state of the pertinent printer hardware condition, as may be represented by a boolean variable such as the paper move-pending flag stored in a memory connected with the printer's controller.

FIGS. 1A and 1B illustrate that by the invented method, while the printer's motor(s) are busy and there is no printing as determined at 10, 12, at 24 it is determined whether there is pending a paper movement and it so then at 26 the paper move-pending flag is set. Upon clearing of the paper move-pending flag as determined at 28, pending paper movement is initiated substantially immediately at 30.

Those of skill in the art will appreciate that determinations 10, 12 preferably are made by the printer's controller in response to feedback from, and/or information regarding, print status and carriage movement, as is known. For example, a firmware servo motor driver for the carriage's servo motor that commands the servo motor to step incrementally to drive the carriage right and left can maintain information in memory regarding its instantaneous position. A timer that forms part of the printer's controller then can prompt, e.g. interrupt, the controller periodically to sense the positional information and to calculate velocity information to enable the controller to estimate or determine, for example, when fully ramped-up carriage travel speed has been achieved. In accordance with the preferred embodiment of the invention, the controller also is able to read a peripheral integrated circuit (IC) that keeps track of the carriage's position. All such is referred to herein as carriage motion logic.

Figure 2A:
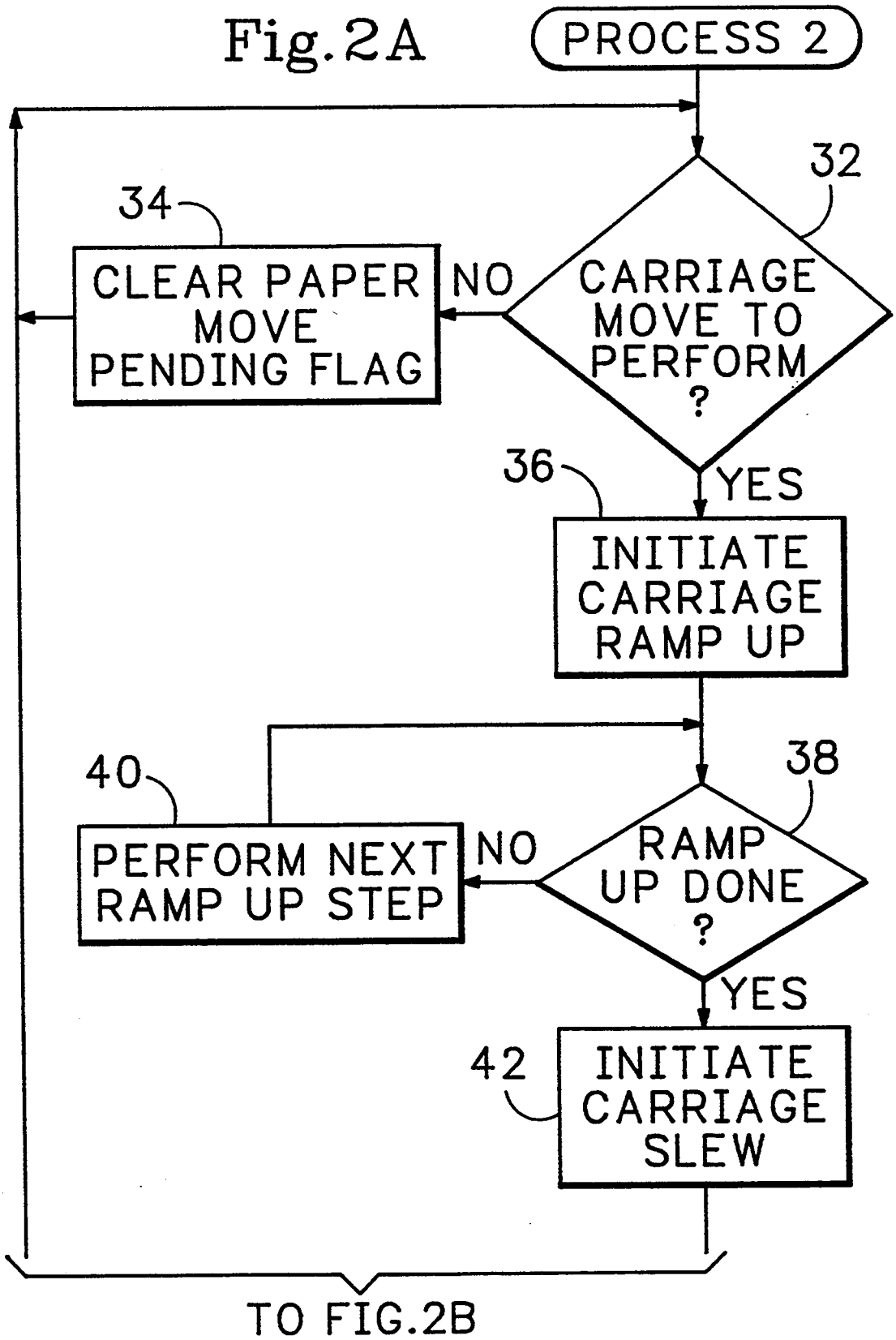
FIGS. 2A and 2B schematically illustrate another process of the invented method in the form of a flowchart.
Figure 2B:
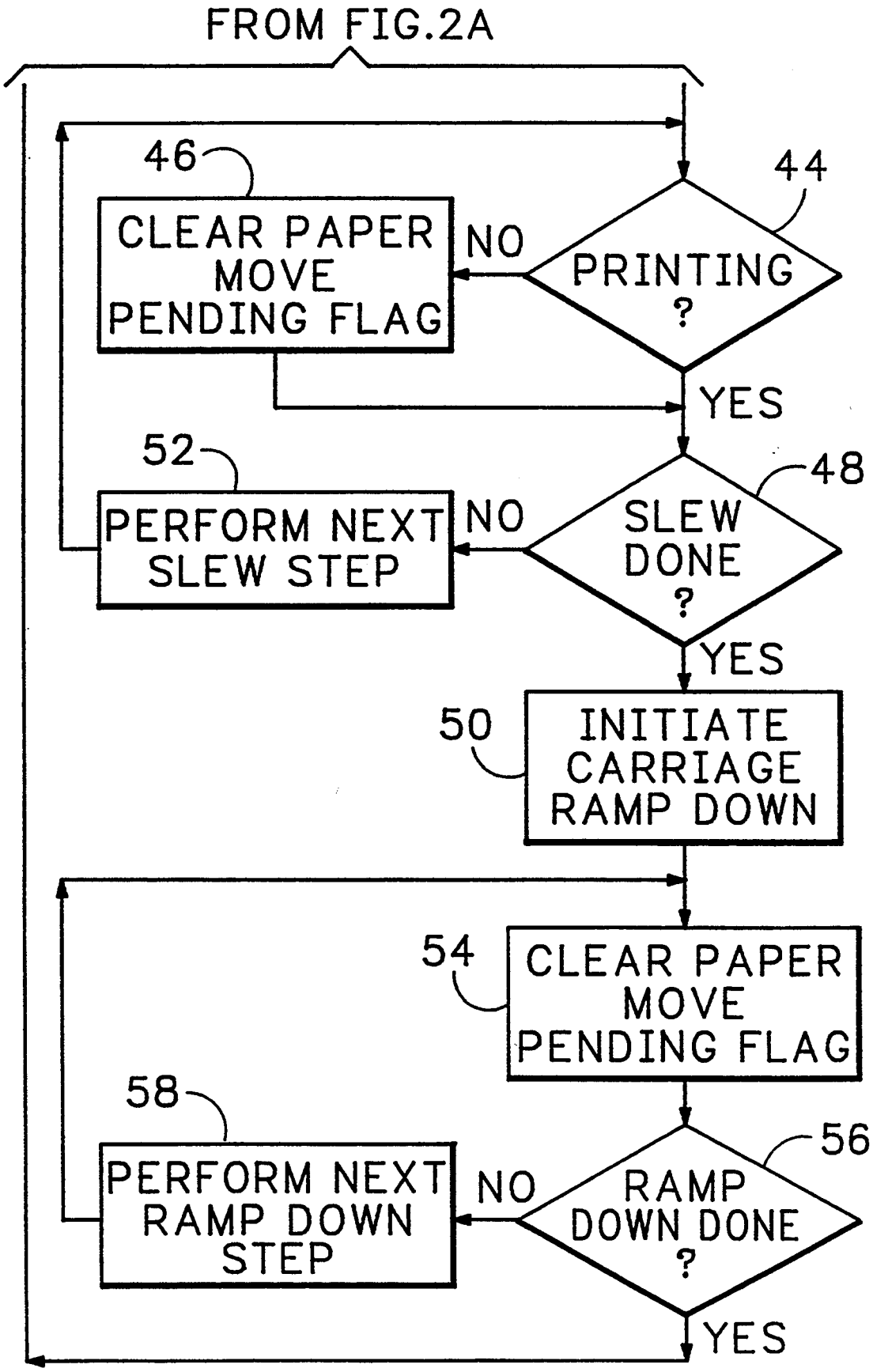

Turning now briefly to FIGS. 2A and 2B, PROCESS 2 is described. It will be understood that PROCESS 2 preferably executes concurrently with PROCESS 1 described above, and is both responsive to and partly controlling of PROCESS 1, as now will be described. At 32 it is determined whether there is a carriage move to perform and if not then the paper move pending flag is cleared at 34. If so, then a carriage ramp up is initiated at 36. At 38, 40 ramp up completion is awaited, and when done carriage slew is initiated at 42. At 44, if it is determined that there is no printing then the paper move-pending flag is cleared at 46, thus signalling PROCESS 1 that non-printing carriage travel has reached full speed. At 48 its is determined whether carriage slew is complete. If the carriage is done slewing then at 50 carriage ramp down is initiated; if the carriage is not done slewing, then at 52 slewing continues.

At 54 of PROCESS 2 as illustrated in FIGS. 2A and 2B, and immediately after it has been determined at 48 that no longer is carriage slew, the paper move-pending flag is cleared, thus signalling PROCESS 1 that paper may be moved, e.g. advanced. Thereafter, if it is determined at 56 that ramp down of the carriage is done, control is returned to the start of PROCESS 2. If it is determined at 56 that ramp down is not yet complete, then at 58 ramp down continues, with control returning to action block 54 thereby to ensure that PROCESS 1 is continuously signaled during ramp down of carriage motion. This ensures that carriage ramp-down motion may be overlapped to the extent needed with paper movement.

Those of skill also will appreciate that the printer's controller straightforwardly can maintain various boolean variables within a memory connected therewith, such variables representing whether there is an impending paper movement or carriage movement. Such is performed in accordance with the preferred method and apparatus by the controller's examination of the print buffer and/or other locations in memory where variables predeterminedly are maintained. It will be understood that much of the information regarding what is referred to herein as look-ahead logic is merely the printer's controller examining memory locations that have been made by the host computer or printer server or driver to contain information regarding how a print document or job will be printed, i.e. a printer buffer contains text, graphics and control codes interpretable by the controller as carriage movement, paper advancement and print commands.

The invented method may be seen to represent an improvement for use with an ink-jet printing method whereby printing is performed during movement of an ink-jet printhead carriage and paper moving is performed therebefore and/or thereafter. In this prior art context, the invented improvement includes moving paper while not printing but while the printer's carriage is moving. The beneficial result of such paper movement is that it produces overlapped carriage and paper movement that increases the printer's throughput. Based on the determinations made at 10, 12, 24, 28 and the actions taken at 26, 30 by PROCESS 1, and based upon the determinations made at 44, 48 and the actions taken at 46, it may be seen that paper is moved while the printer is not printing but while the carriage is moving, thereby producing overlapping carriage and paper movement. Such overlapping, or concurrency, of motion between the paper and the carriage is between approximately 75% and 100%. The 75% figure represents overlap in those cases where paper motion is overlapped only with the ramp-down, or deceleration, motion of the printer's carriage, and the 100% figure represents overlap in those cases where paper motion is overlapped with continuous motion of the printer's carriage, e.g. to the start of the next line of print.

Accordingly, it is preferable that the paper moving step of the improvement is performed at times at least including substantially constantspeed non-printing carriage movement, as illustrated by the logic of the PROCESS 1 flowchart including decision blocks 12, 18 and action block 20. It is more preferable that the paper moving step is performed at times further including declining-speed, or ramp-down, non-printing carriage movement, as illustrated by the logic of the flowchart of PROCESS 1 including decision blocks 14, 16, 22 and action blocks 18, 20, and as illustrated by the logic of the flowchart of PROCESS 2 including decision blocks 44, 48 and action blocks 50, 54. In either event, it is preferable that the paper moving step of the improvement is performed selectively such that there is substantially no overlap between paper movement and increasing speed, or ramp-up, non-printing printer carriage movement. This last, illustrated in the flowchart of PROCESS 2 by decision blocks 32, 38 and by action blocks 36, 40 as imposing an effective delay during ramp-up movement of the carriage, avoids overtaxing the power supply with simultaneous current-intensive carriage ramp-up and paper movement demands.

The invented apparatus now may be understood in view of the preferred method and the improvement represented thereby. It will be appreciated that the printer's controller executing concurrent PROCESSes 1 and 2 forms what may be described as first and second processors. Thus, the invention may be described as apparatus for increasing printer throughput may be thought of as including a first processor (PROCESS 1) for controlling movement of printer paper, with the first processor determining at 12, 24 whether while not printing there is a pending carriage movement and if so then setting a flag at 26 and upon the clearing of the flag at 28 initiating the pending paper movement. The invented apparatus also includes a second processor (PROCESS 2) for controlling movement of a printer carriage, with the second processor determining at 32 whether there is a pending carriage movement and if not then at 34 clearing the flag. The second processor further determines after a carriage movement at 38 whether the printer's carriage is at full speed and at 44 whether there is no printing and if so then at 54 clears the flag.

It will be appreciated that the paper move-pending flag set by PROCESS 1 and cleared by PROCESS 2 is the same flag, which is used to signal the concurrently executing processes of one or more changes in the condition of variables and or printer hardware operations. Importantly, the first and second processors (PROCESS 1, PROCESS 2) cooperate with one another—e.g. by making independent but concurrent determinations based upon next state variables governing the impending printer operations and by setting and resetting a shared flag to signal one another and to begin the movement of paper—to initiate a next paper movement such that the same is performed concurrently, or in overlapped fashion, with present carriage movement that is of substantially constant or of declining speed, but not concurrently, or in overlapped fashion, with a current carriage movement that is of increasing speed, i.e. ramp-up or acceleration movements of the carriage are avoided.

Preferably, the first processor (PROCESS 1) also determines at 14 whether there is pending a non-printing carriage movement and if not then at 16 whether there is a pending paper movement and if so then at 18 sets the pending paper-move flag. Further at 20 and upon the clearing of the flag by the second processor as determined by the first processor at 22, the first processor initiates pending paper movement to produce overlapped motion of the printer's paper roller drive mechanism (driven by one of the motors alluded to at decision block 10 of FIG. 1A) and its carriage drive mechanism (driven by another of the motors alluded to therein).

It will be appreciated that the first and second processors may be implemented in hardware, firmware or software, or any suitable combination, although they are, in accordance with the preferred embodiment of the invention described herein, implemented in firmware stored in memory within the printer's controller and executed by a microprocessor or microcontroller. It also will be appreciated that their decision-making and paper movement servo motor- and printhead carriage servo motor-controlling steps may be organized differently, yet within the spirit and scope of the invention. Finally, it will be appreciated that more or less paper and carriage movement may be overlapped, or performed concurrently, to achieve more or less efficient printer operation depending upon servo motor, power supply, and other printer subsystem or component limitations or performance criteria such as print quality, throughput and cost goals.

INDUSTRIAL APPLICABILITY

It may be seen then that the invented method and apparatus substantially increase printer throughput without substantially increasing demand on the printer's power supply. The method and apparatus are useful especially in ink-jet printers having single-line print data buffers that permit look-ahead logic that is a part of the printer's controller to optimize the concurrency with which carriage and paper motion are performed while there is no actual printing in progress. Concurrent carriage and paper motion being possible, nevertheless in certain cases the controller wisely defers initiating overlapped motion to a later time when such will be more effective. Importantly, the preferred method and apparatus permit overlapped carriage and paper motion during constant-speed and ramp-down times of the printer's carriage movement, yet avoid ramp-up times thereof.

While the present invention has been shown and described with reference to the foregoing operational principles and preferred method and embodiment, it will be apparent to those skilled in the art that other changes in form and detail may be made therein without departing from the spirit and scope of the invention as defined in the appended claims.

We claim:

1. An automatic printer control method implemented in a printer's controller for increasing printer throughput, the method comprising the steps of:

first determining while printing whether there is pending a non-printing carriage movement; and if so then deferring paper movement until a later time when non-printing carriage travel has reached full speed; and if not then determining whether there is pending a paper movement and if so then initiating paper movement substantially immediately after printing stops.

2. The method of claim 1 which further comprises, in the case that said first determining step results in said deferring, initiating said paper movement substantially immediately after such carriage travel has reached such full speed.

3. Apparatus for increasing printer throughput comprising:

a first processor for controlling movement of printer paper, said first processor determining whether while not printing there is a pending paper movement and if so then setting a flag and upon clearing of said flag initiating such said pending paper movement, and a second processor for controlling movement of a printer carriage, said second processor determining whether there is a pending carriage movement and if not then clearing said flag, said second processor further determining after a carriage movement whether the carriage is at full speed and whether there is no printing and if so then clearing said flag, said first and said second processors cooperating with one another to initiate said pending paper movement such that said pending paper movement is performed concurrently with a current carriage movement that is of substantially constant speed.

4. The apparatus of claim 3, wherein said first processor further determines whether there is pending a non-printing carriage movement and if not then whether there is said pending paper movement and if so then setting said flag and upon the clearing of said flag initiating such said pending paper movement.

5. The apparatus of claim 3, wherein said second processor further clears said flag after printing.

* * * * *